United States Patent [19]

Tomelleri

[11] Patent Number: 5,016,464

[45] Date of Patent: May 21, 1991

[54] APPARATUS FOR REPAIRING ACCIDENT-DAMAGED BODIES IN MOTOR VEHICLES

[75] Inventor: Raffaele Tomelleri, Verona, Italy

[73] Assignee: Garda Impranti, Verona, Italy

[21] Appl. No.: 442,296

[22] Filed: Nov. 27, 1989

[30] Foreign Application Priority Data

Dec. 22, 1988 [IT] Italy ..... 84975 A/88

[51] Int. Cl.[5] ..... B21D 01/12

[52] U.S. Cl. ..... 72/447; 72/705

[58] Field of Search ..... 72/447, 705

[56] References Cited

U.S. PATENT DOCUMENTS 3,492,855 2/1970 Wylie ..... 72/705
3,667,275 6/1972 Hunnicutt ..... 72/705
3,691,817 9/1972 Friend et al. ..... 72/705
4,221,122 9/1980 Couturier ..... 72/705

*Primary Examiner*—Lowell A. Larson

[57] ABSTRACT

The apparatus comprises a horizontally-extending base (2) mounted on wheels (3) and providied at one end (4) with anchoring means (5) locking it to a repair bench (6) and at the opposite end (9) with a pair of double-acting hydraulic jacks (11, 12) hinged thereto and joined together at a junction point (P) which is raised relative to the base (2). Connected to the junction point (P) is a third double-acting hydraulic jack (16, 33) which is intended to carry out a pulling or thrust action in order to straighten the deformed part (21) of a damaged vehicle body. The junction point (P) defined by the intersection of the pair of jacks (11, 12) hinged to the second base end (9), can be shifted in space without discontinuity and can therefore take any appropriate position for a correct and quick straightening of the deformed body.

11 Claims, 3 Drawing Sheets

APPARATUS FOR REPAIRING ACCIDENT-DAMAGED BODIES IN MOTOR VEHICLES

FIELD AND BACKGROUND OF THE INVENTION

The present invention relates to an apparatus for repairing damaged bodies in motor vehicles. Currently known apparatus for repairing damaged bodies in motor vehicles can be divided intp two different structural groups.

One group comprises a substantially upright pulling arm carried by a base frame, essentially consisting of a straight longitudinal member provided with hooking means and a repair bench on which the motor vehicle to be repaired stands. The upright arm can be rotated about its own base end, notches being provided for the engagement of locking fingers thereinto. The positioning of the pulling arm can be therefore accomplished in a discrete manner, due to the distance existing between the locking notches, which brings about the fact that the pulling position is not always perfectly correct. Operation of the arm takes place by the use of a hydraulic jack connecting the base frame to said arm. However it is known that this configuration can enable only a tractive action on the body's deformed part and not a thrust action as well which, if necessary, must be performed by other appropriate equipments.

The second group of known apparatus comprises a base structure which is fastened to the repair bench and to the end of which a pulling chain is secured. Acting on said chain is a hydraulic jack fastened to the base structure itself. In this case as well, the orientation of the pulling direction appears difficult and a thrust action on the deformed part of the body to be straightened is also impossible and, as in the preceding case, it must be performed by other equipments.

It is also to be noted that in both cases during the straightening step the pulling direction is modified, which involves disadvantages as regards accuracy in the straightening operation unless continuous adjustments are carried out by the operator, but this is time-consuming.

SUMMARY OF THE INVENTION

Consequently, the main object of the present invention is to overcome the above mentioned drawbacks which are present in known equipments, by providing an apparatus by which it is possible to achieve a continuous modification in the pulling direction and carry out a thrust action on the deformed part of the motor vehicle body, without the use of other equipments, all operations being performed in a very quick and precise manner.

Another object of the invention is to provide an apparatus adapted to be controlled by a computerized system so that the working time and the accuracy in straightening the deformed body can be optimized.

The foregoing and further objects are attained by the apparatus of the invention for repairing damaged bodies in motor vehicles, the main features of which are set forth in the following claims.

BRIEF DESCRIPTION OF THE DRAWINGS

Further features and advantages of the invention will best be understood from the detailed description of two preferred embodiments given hereinafter by way of non limiting example in the accompanying drawings, in which.

DESCRIPTION OF THE PREFERRED EMBODIMENTS

Figure 1:
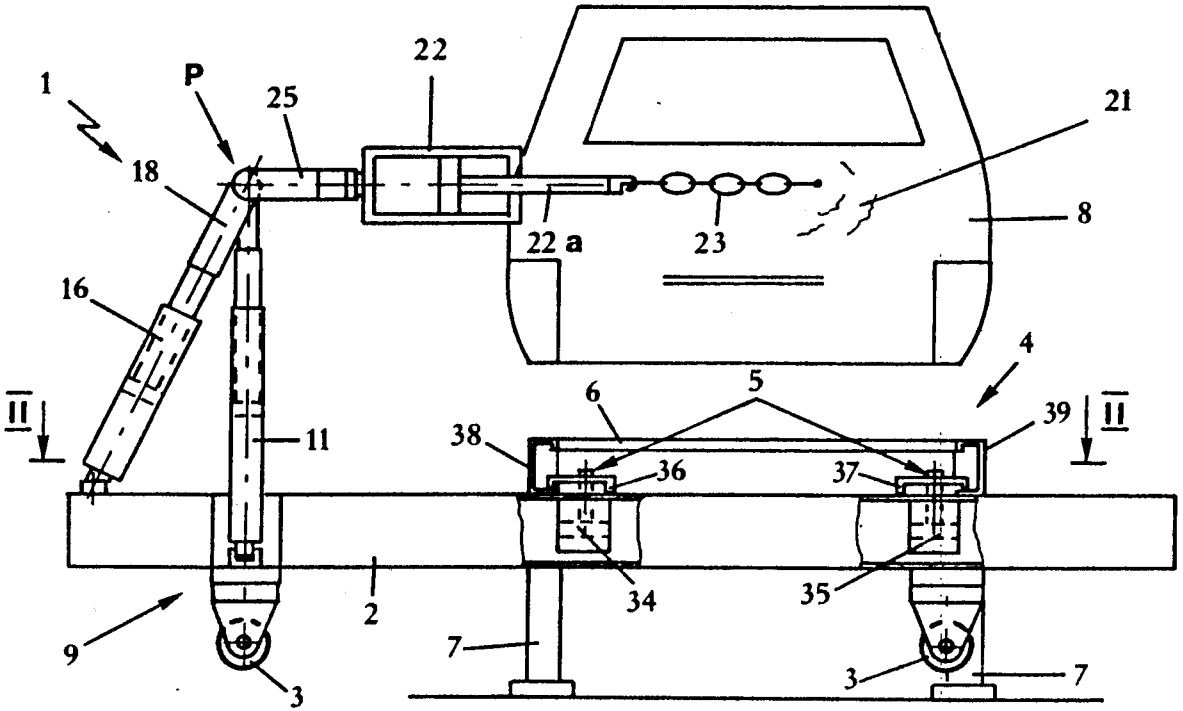
FIG. 1 is a schematic side view of the apparatus of the invention according to one preferred embodiment, fastened to a repair bench.
Figure 3:
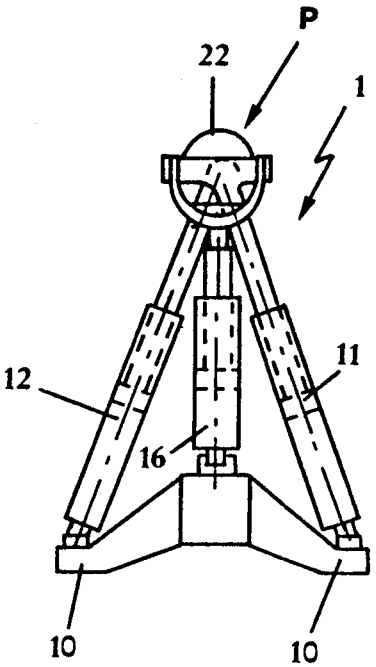
FIG. 3 is a diagrammatic front view of part of the apparatus shown in FIG. 1.

Referring to the drawings, the apparatus of the invention has been generally identified by reference numeral 1.

Apparatus 1 comprises a horizontally extending base 2 consisting of a straight longitudinal member mounted on wheels. Base 2 is provided at one end 4 with anchoring means 5 for locking it to a repair bench 6 equipped with support legs 7 and carrying an damaged motor vehicle body, and at the other end 9 with a pair of supports 10 projecting sideways. Hinged to the supports 10 are a pair of double-acting hydraulic jacks 11 and 12 (more generally they can consist of any type of linear actuators) joined together at a junction point P which is raised relative to base 2.

Figure 4:
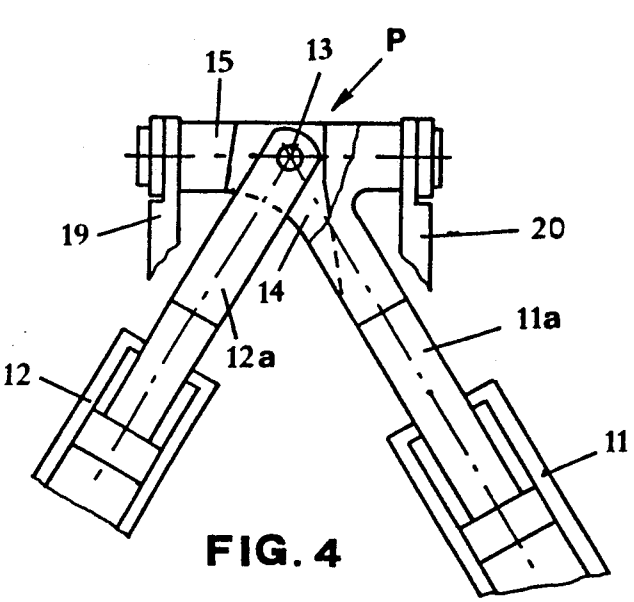
FIG. 4 is a diagrammatic view of the particular connection between a pair of hydraulic jacks joined together at a junction point.
Figure 6:
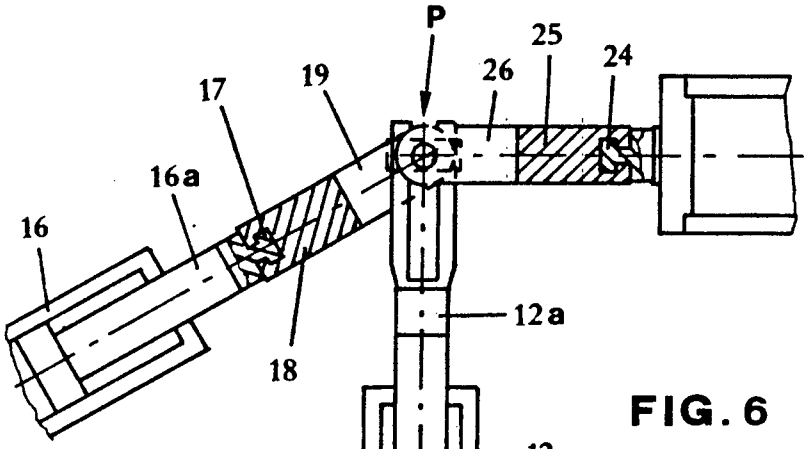
FIG. 6 is a diagrammatic sectional view of part of the apparatus, taken along line VI—VI in FIG. 5.

As particularly shown in FIGS. 4 and 6, the rod 12*a* of the hydraulic jack 12 is substantially in the form of a fork and is hinged at 13 within a housing 14 formed on the sleeve-shaped end 15 of the rod 11*a* belonging to the other jack 11. Jacks 11 and 12 as disposed, enable the junction point P to be continuously oriented with two degrees of freedom.

According to one preferred embodiment (particularly shown in FIGS. 1 and 2) a third double-acting hydraulic jack 16 is hinged to the second end 9 of the base 2 and connected to the junction point P so as to form, together with jacks 11 and 12, a substantially pyramidal structure with triangular base.

Figure 5:
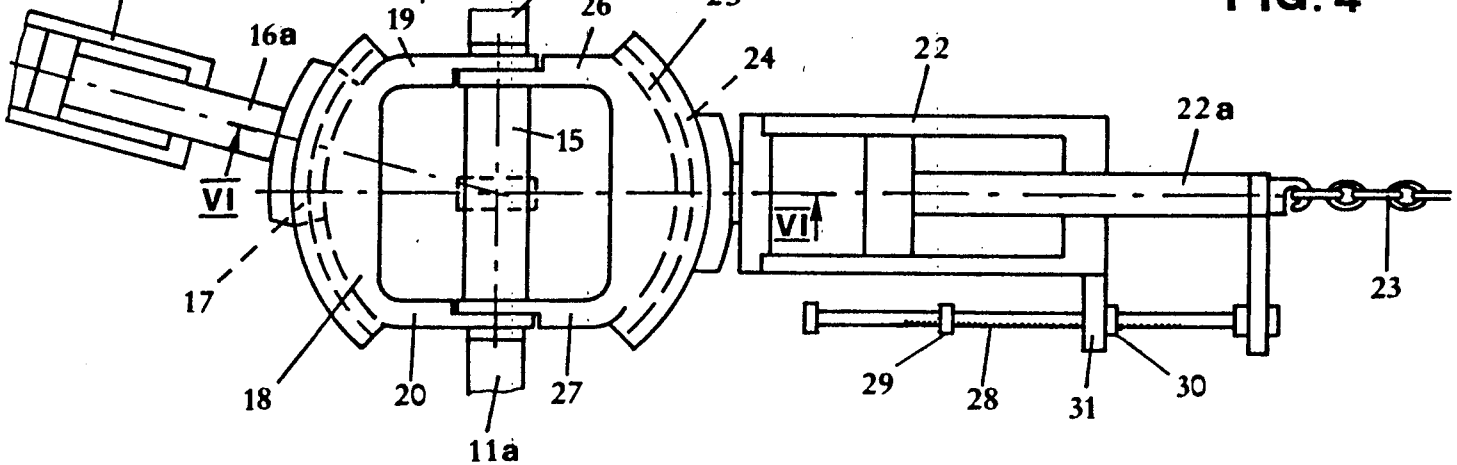
FIG. 5 is a diagrammatic top view of part of the apparatus in question.

As viewed particularly in FIGS. 5 and 6, the rod 16*a* of jack 16 ends in an arched slider 17 slidably fitted in a shaped structural element 18 having the form of a sector of a cercle and exhibiting two small arms hinged to the sleeve 15 ends. Due to the pyramidal structure thus formed it is possible to continuously orient point P in space with three degrees of freedom.

The third jack 16 enables the straightening by drawing of the deformed part 21 of body 8 through the connection of point P to said deformed part, for example by means of a chain (not shown).

Figure 2:
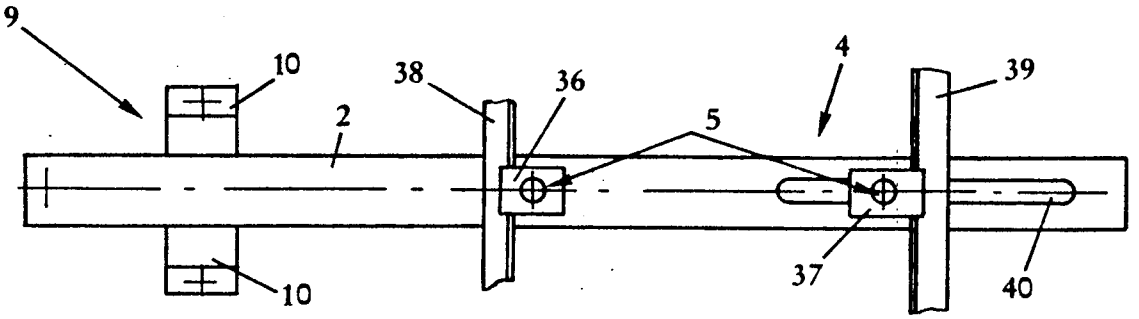
FIG. 2 diagrammatically shows a sectional view of the apparatus, taken along line II—II in FIG. 1.

Still referring to the first preferred embodiment, provision may be made for a fourth double-acting hydraulic jack 22 fastened to point P and serving to execute the straightening of the deformed part 21 by a pulling or thrust action, in which case its rod 22*a* will be rigidly fixed to the deformed part 21. In FIG. 1 there is a chain 23 interposed between the fourth jack 22 and the area 21. Obviously in this case the fourth jack 22 will only exert a pulling action.

The correct orientation of the pulling direction is attained by merely operating jacks 11 and 12 and, if necessary, also the third jack 16, should one wish to modify the distance between point P and the area 21 for the purpose of utilizing the pulling equipments with the best results.

As shown in FIGS. 5 and 6, the fourth jack 22 exhibits an arched slider 24 at the base thereof. Such slider is slidably fitted in an element having the form of a sector of a circle with two small arms 26 and 27 hinged to the ends of the sleeve 15.

Associated with the fourth jack 22 is a graduated bar 28 integral with rod 22*a* and carrying a pair of friction-sliding washers 29 and 30, and interposed between said washers is a member 31, slidable along the bar 28 as well, which is integrally connected to the cylinder of jack 22.

By virtue of this arrangement it is possible to best evaluate the repair operation because washers 29 and 30 by their moving, enable a clear vision of the displacement carried out during the straightening step, taking of course into account the spring return of the material forming the deformed part 21. Furthermore, the overcoming of the exact measure can be avoided and the above arrangement enables the operator to reach the final straightening position more readily.

Figure 8:
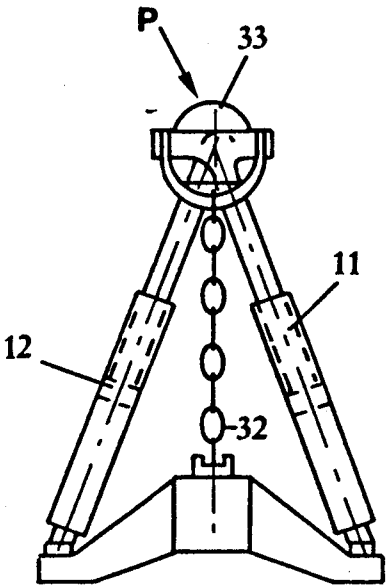
FIGS. 7 and 8 are diagrammatic side and front views respectively of the present apparatus according to a second embodiment.
Figure 7:
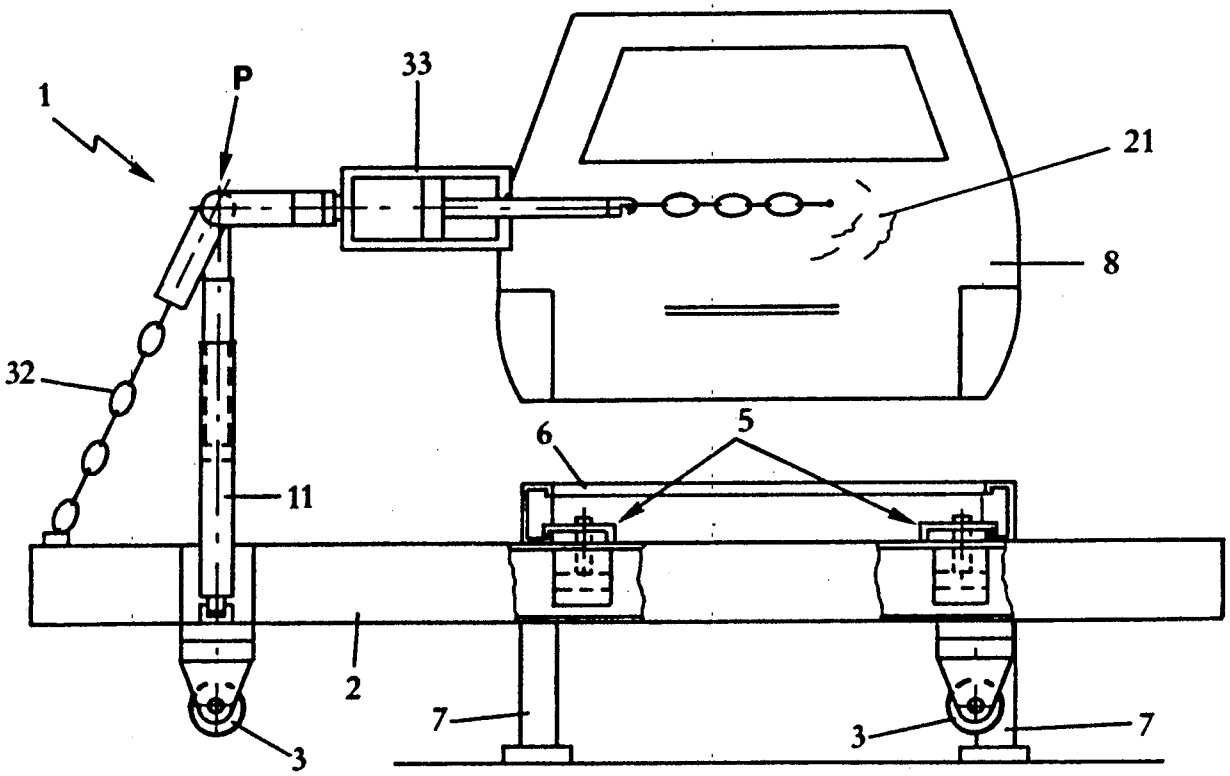

In accordance with a second preferred embodiment (particularly shown in FIGS. 7 and 8), the third jack is replaced by a chain 32 (or similar member) which together with jacks 11 and 12 forms a pyramidal structure with triangular base.

In this case the apparatus 1, as regards the pulling group, consists of only three jacks, i.e. the pair of jacks 11 and 12 intended for orienting the pulling direction (with two degrees of freedom), and a third double-acting hydraulic jack 33 (quite similar to the fourth jack 22 in the preceding case) secured to point P and designed for carrying out the straightening of the deformed part 21. In this case the previously described device involving a graduated bar 28 can be associated with said third jack 33.

Turning back to FIGS. 1 and 2, the anchoring means 5 consists of a fifth and a sixth jacks 34 and 35 each of them having a rod provided with a bracket 36 and 37 designed to engage in the corresponding longitudinal member 38 and 39 of the repair bench 6.

The fifth jack 34 is fixed to the base 2 whereas the sixth jack 35 is movable relative to said base on which it can be adjusted in position being fitted in a rectilinear slit 40.

The anchoring means 5 as structured enables the apparatus 1 to be easily positioned on the bench 6 at any desired location and without the bench being set in motion (raised or lowered).

It will be appreciated that the apparatus 1 can be advantageously combined with a numerical control system and in particular with the apparatus being the subject of the U.S. patent pending Ser. No. 189,227, now U.S. Pat. No. 4,891,889 granted Jan. 9, 1990, filed in the name of the same applicant and entitled "Apparatus to measure and/or check the position and orientation of characteristic spots or areas in structures, particularly in motor vehicle bodies".

In this case in which an automatic control of the apparatus 1 is provided, instead of the hydraulic distributor solenoid valves are used for operating the jacks or, alternatively, servo valves or proportional valves (not shown in the accompanying drawings), which valves are controlled by the numerical control system or the apparatus disclosed in the above U.S. patent pending Ser. No. 189,227.

In this case a piloted or automatic pulling action can be provided. In fact, by operating jacks 11 and 12 and optionally jack 16 it is possible to automatically correct the pulling direction so that the apparatus 1 can straighten the deformed part 21 with the greatest accuracy. This result can be achieved by measuring the spot to be repaired by a position transducer.

In actual fact, the apparatus disclosed in the above U.S. patent pending is applied to the deformed area 21 and chain 23 is used as a pulling member. The operator commands the operation of jacks 16, or 22 or 33 depending upon the structure of the apparatus 1, for the execution of a pulling action and automatically, as the pulling is carried out, the apparatus disclosed in the above mentioned U.S. patent pending Ser. No. 189,227 gives data relative to the displacements carried out by the deformed part 21. Through a series of solenoid valves connected to the jacks and controlled by the above apparatus, the equipment for straightening the deformed part 21 is set in motion and all operations are accomplished automatically.

Obviously, in case of use of the automatic straightening system, the device shown in FIG. 5 and contemplating a graduated bar 28 is quite superfluous.

The apparatus 1 as conceived, either if operated manually or automatically, enables the pulling direction to be continuously modified (by shifting the junction point P), which brings about the possibility of orienting the pulling or thrust action in all directions within a solid angle defined by the possibilities of displacement of jacks 11 and 12, and optionally 16.

In case of manual operation, the above described apparatus 1 is fed by a hydraulic control box (not shown for the sake of simplicity) and controlled by the operator through a hydraulic multi-outlet distributor (not shown too).

The main advantages attainable by the use of apparatus 1 are the following:

a reduced time in the application of apparatus 1 to the repair bench 6 and the possibility of positioning the apparatus relative to the bench according to the desired orientation (within some limits);

the possibility of covering a wide repair area with reference to the pulling or thrust directions (which can be horizontal or vertical and directed downwardly or upwardly) almost without the intervention of the operator;

the orientation of the repair direction is carried out by the use of hydraulic jacks (however other appropriate technically equivalent means can be used as well) and the intervention of the operator is only restrained to some commands through levers or pushbuttons. The orientation is reached quickly and with precision and a very accurate repair is achieved;

when apparatus 1 is operated by a numerical control system (be it a computer or the apparatus disclosed in the above U.S. patent pending Ser. No. 189,227) which is provided with suitable position transducers, repairs are still more accurate and quicker;

the use of a fourth jack 22 (or a third jack 33 in the second embodiment) located directly along the pulling or thrust direction, allows such direction to remain unchanged while the repair is taking place. As a result, by the use of a manometer it is possible to check either the tractive force or the thrust force and consequently ascertain whether the work is being carried out under a condition of elastic deformation or yielding of the material forming the area 21 to be repaired.

the operator is safer during his work because the junction point P (in case of use of the three jacks 11, 12 and 16) does not remarkably shift should the pulling chain break. If the fourth jack 22 (or third jack 33) located directly along the repair direction is used, the operator is still more safer because it is possible to surely restrain the load applied to the pulling chain 23.

The invention attains the intended purposes.

Obviously in its practical form of embodiment, the apparatus may also adopt configurations that differ from those herein illustrated without however departing from the scope of the inventive idea characterizing it. In addition, all of the details may be replaced by technically equivalent elements and the sizes and materials used may be of any nature and magnitude in accordance with requirements.

What is claimed is:

1. An apparatus for reporting a damaged body of a motor vehicle comprising:

a horizontally extending base;

wheels supporting said base for translation thereon;

anchoring means connected to one end of said base for locking said base to a work bench;

a pair of linear actuators each hinged at one end thereof to the opposite end of said base, the other actuator ends being joined together at a junction point, said junction point being elevated above said base;

a third linear actuator connected at one end to said junction point, the other end of said actuator being subject to connection to said damaged body.

2. The apparatus as claimed in claim 1, wherein said other end of said third linear actuator is hinged to said opposite end of the base so as to form, together with said pair of linear actuators, a substantially pyramidal structure with a triangular base.

3. The apparatus as claimed in claim 2, and further comprising a fourth linear actuator connected at one of its ends to said junction point, said fourth linear actuator being subject at its other end to attachment to said vehicle body.

4. The apparatus as claimed in claim 3, and further comprising a graduated bar carrying a pair of friction-slidable washers having a member interposed between said washers, said interposed member being slidable along said graduated bar and integrally connected to said fourth linear actuator.

5. The apparatus as claimed in claim 3, wherein said linear actuators are double-acting hydraulic jacks.

6. The apparatus as claimed in claim 1, wherein said anchoring means includes a fifth and sixth linear actuators, each actuator having a movable member, the movable members of said actuators having an attached bracket adapted to engage with a member of said repair bench.

7. The apparatus as claimed in claim 6, wherein said fifth linear actuator is fixed to the base and said sixth linear actuator is movable relative to said base, and further comprising means for guiding the motion of said sixth actuator between said one and opposite ends of said base, so that said sixth actuator may be adjusted in position on the base.

8. The apparatus as claimed in claim 6, wherein said linear actuators are double-acting hydraulic jacks.

9. The apparatus as claimed in claim 7, wherein said linear actuators are double-acting hydraulic jacks.

10. The apparatus as claimed in claim 9, wherein said one end of said third linear actuator is hinged to said junction point, and further comprising an elongated member, said elongated member being suitable for pulling but having little compressive strength between said ends, said elongated member connecting said junction point to said opposite end of said base, forming with said pair of linear actuators a substantially pyramidal structure with a triangular base.

11. The apparatus as claimed in claim 10, wherein said elongated member suitable for pulling is a chain.

* * * * *